US006338478B2

(12) United States Patent
Baculy

(10) Patent No.: US 6,338,478 B2
(45) **Date of Patent: *Jan. 15, 2002**

(54) CLAMP FIXTURES

(75) Inventor: Eric J. Baculy, Cedar Springs, MI (US)

(73) Assignee: Adjustable Clamp Company, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/787,971

(22) Filed: Jan. 23, 1997

(51) Int. Cl.[7] ..... B25B 1/24
(52) U.S. Cl. ..... 269/166; 269/147; 269/282; 269/283
(58) Field of Search ..... 269/279–284, 269/47, 166–171, 265, 147–149

(56) References Cited

U.S. PATENT DOCUMENTS

| | | | | | |
|---|---|---|---|---|---|
| 307,453 | A | * | 11/1884 | Galbraith | 269/281 |
| 641,694 | A | | 1/1900 | Hamelehle | |
| 665,398 | A | | 1/1901 | Broadbooks | |
| 800,685 | A | | 10/1905 | Scoggins | |
| 890,063 | A | | 6/1908 | Jones | |
| 1,015,171 | A | | 1/1912 | Goble | |
| 1,498,638 | A | * | 6/1924 | Periolat | 269/47 |
| 1,669,443 | A | | 5/1928 | Billstrom | |
| 2,258,686 | A | | 10/1941 | Olney | |
| 2,340,316 | A | | 2/1944 | Fest | |
| 3,154,304 | A | * | 10/1964 | Crawford | 269/47 |
| 3,403,901 | A | | 10/1968 | Servadio | |
| 3,499,206 | A | * | 3/1970 | Quernheim | 269/283 |
| 3,767,183 | A | | 10/1973 | Van Gelder | |
| 4,052,046 | A | | 10/1977 | Mortoly | |
| 4,068,834 | A | | 1/1978 | Mortoly | |
| 4,134,578 | A | | 1/1979 | Stanley | |

(List continued on next page.)

FOREIGN PATENT DOCUMENTS

| | | | | |
|---|---|---|---|---|
| CH | 322734 | | 6/1957 | |
| DE | 110453 | | 7/1899 | |
| DE | 1269967 | | 6/1968 | |
| DE | 3631048 | * | 4/1987 | 269/283 |
| DE | 8700775 | | 5/1987 | |
| DE | 9112721 | | 5/1992 | |
| EP | 0300473 | | 7/1988 | |
| FR | 984890 | * | 2/1951 | 269/281 |

*Primary Examiner*—Robert C. Watson
(74) *Attorney, Agent, or Firm*—Price, Heneveld, Cooper, DeWitt & Litton

(57) ABSTRACT

Adaptors for interchangeably connecting any of a plurality of clamping fixtures to various beam clamp assemblies include an adaptor block or body, a fastener attached to the adaptor block for releasably securing the adaptor block to a jaw of a beam clamp assembly, and a connector on the adaptor block for releasably attaching a workpiece clamping fixture to the adaptor block. A clamping system utilizing the adaptors may include one or a plurality of different types of beam clamp assemblies, each of which may have jaws which are differently configured, one or more adaptors, each having a fastener specially configured to facilitate releasable attachment to one of the plurality of different types of beam clamp assemblies, each of the adaptors also including a connector for releasably attaching a workpiece clamping fixture to the adaptor, and one or more workpiece clamping fixtures, each clamping fixture including a connector configured to engage the connector on any of the adaptors and facilitate releasable attachment of the clamping fixture to any of the adaptors. The clamping system allows a workpiece clamping fixture to be mounted onto any of a plurality of different beam clamp assemblies having differently configured jaws to provide greater flexibility in the selection of clamping fixtures and beam clamp assemblies for performing a particular job on a particular workpiece.

11 Claims, 7 Drawing Sheets

U.S. PATENT DOCUMENTS 4,363,475 A 12/1982 McCarty
4,422,629 A * 12/1983 Carlson ..... 269/282
4,437,654 A 3/1984 Chiappetti
4,583,724 A 4/1986 Huang
4,662,618 A 5/1987 Willis
4,779,857 A 10/1988 Maund
4,898,371 A * 2/1990 Mills et al. ..... 269/280
4,921,234 A 5/1990 Peterson
4,923,186 A * 5/1990 Durfee ..... 269/280
4,953,840 A * 9/1990 Nishimura ..... 269/282
5,002,264 A 3/1991 Nimtz
5,064,178 A 11/1991 Nimtz
5,129,350 A 7/1992 Marelin
5,163,665 A 11/1992 Klearman
5,246,216 A 9/1993 Oberst
RE34,953 E * 5/1995 Denny et al. ..... 269/284
5,443,246 A 8/1995 Peterson
6,039,313 A * 3/2000 Baculy ..... 269/283

* cited by examiner

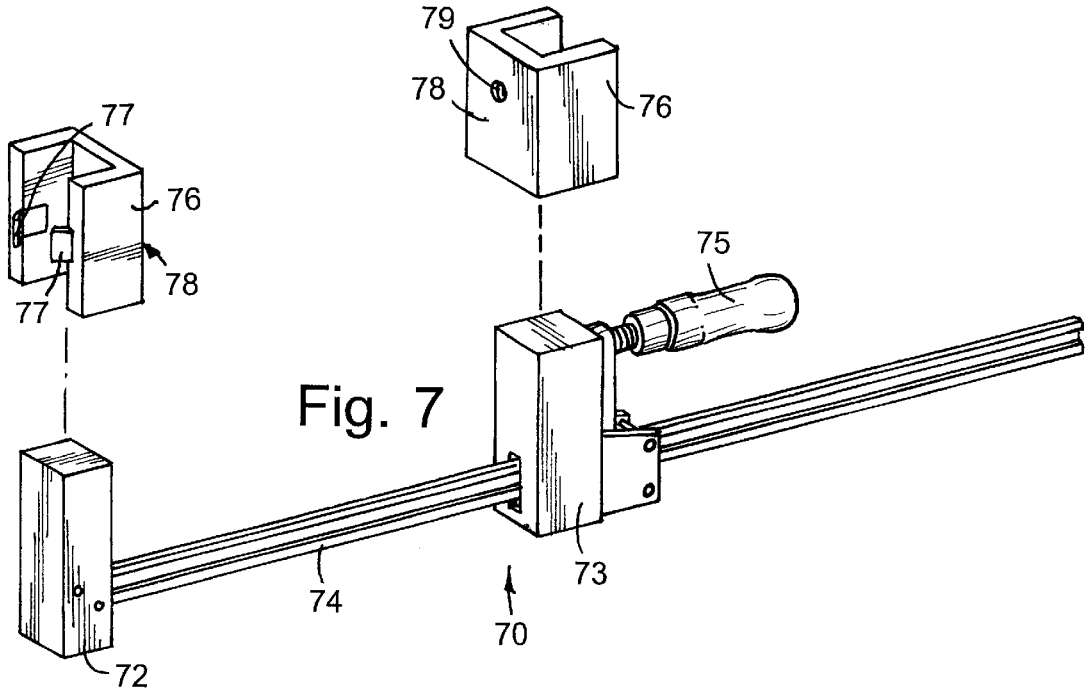
Fig. 7
Fig. 8
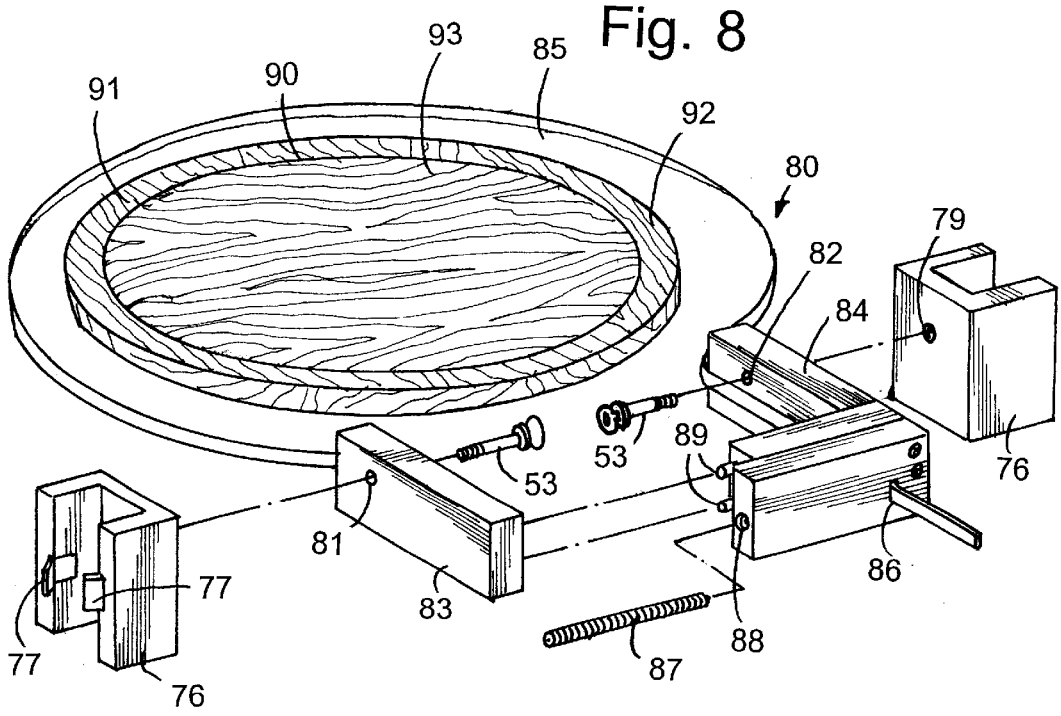

CLAMP FIXTURES

FIELD OF THE INVENTION

This invention relates to clamp fixtures of the type used in association with pipe clamps and bar clamps, and more particularly to clamping systems which are easily reconfigurable to facilitate use of any of various different clamping fixtures which are specially adapted for clamping certain types of workpieces or other articles.

BACKGROUND OF THE INVENTION

Pipe clamp assemblies and bar clamp assemblies, hereinafter collectively referred to as beam clamp assemblies, are commonly used to hold workpieces or other articles in a fixed position for various operations such as cutting, drilling, nailing, screwing, gluing, etc. Beam clamp assemblies generally comprise a linear beam (e.g., a pipe, rod or bar), and a pair of opposing jaws, at least one of which is slidably supported on the beam. A first of the jaws is either fixed to one end of the beam or includes a locking device for holding the jaw in a selected position on the beam. A linear actuator is provided to linearly advance the second jaw toward and away from the first jaw to apply and relieve pressure on an article interposed between the jaws. Typically, the jaws of beam clamp assemblies have parallel opposing gripping surfaces. Accordingly, beam clamp assemblies are generally adapted for clamping workpieces or other articles having flat, parallel opposing surfaces. However, in order to clamp a variety of articles or workpieces at nonplanar surfaces or surfaces which are not parallel to the gripping surface of the jaws, specially designed fixtures or jigs are generally utilized. For example, to grip the corner of a picture frame, specially configured miter jigs having mitered gripping surfaces have been designed. These specialty jigs have been provided with integral fasteners, such as sockets or clips, to allow attachment of the jigs to the jaws of the beam clamp assembly. A disadvantage with conventional jigs is that they are designed for attachment to a particular type or model of beam clamp assembly and cannot be used interchangeably with beam clamp assemblies having jaw gripping surfaces of a size or shape which is not suitably configured to cooperatively receive the integral fasteners on the jigs. This lack of interchangability can be a disadvantage and inconvenience to workers who must match the jig for a particular job to a specific type of beam clamp assembly which may, for example, be unavailable because it is being used for another job.

It is desirable that jigs or fixtures used for clamping a particular type of workpiece or article be firmly secured to the jaws of the beam clamp assembly to prevent shifting of the fixtures relative to the workpiece or article during clamping and subsequent operations. As a result, the dimensional tolerances between the jaws and the integral fasteners on the jigs are extremely low. Consequently, another disadvantage with conventional clamping fixtures is that installation of the fixtures onto the jaws and removal of the fixtures from the jaws can be relatively difficult and time consuming.

When a beam clamp assembly is used without a special fixture or jig, such as to clamp an article or workpiece having opposing parallel, planar surfaces, it is generally desirable to provide a protective layer between the gripping surfaces of the jaws and the gripped surfaces of the article or workpiece being clamped, to prevent abrasion of the surface of the clamped article or workpiece by irregularities, such as bumps and protuberances, which are generally inherently formed during casting of steel jaws. For this purpose, rubber clamp pads which can be slipped over the gripping surfaces of the jaws have been provided. While conventional clamping pads provide some protection against abrasion, there are several disadvantages associated with their use. Included among the disadvantages of conventional rubber, slip-on clamping pads is that because of the flexibility and deformability of the rubber pads, true clamping pressure between the jaws and the workpiece is not achieved, and the rubber pads can tend to slip or shift relative to the jaws during clamping or subsequent operations on a workpiece being clamped. Another disadvantage with conventional beam clamping systems and rubber clamping pads is that the rubber clamping pads must be removed when a specialty clamping fixture is used, and replaced when it is desired to again use the beam clamp assembly to clamp a workpiece having parallel, planar opposing surfaces. Thus, reconfiguring a beam clamp assembly between a configuration in which a specialty jig is used and one in which clamping pads are used can be difficult and time consuming.

SUMMARY OF THE INVENTION

This invention provides adaptors for interchangeably connecting any of a plurality of clamping fixtures to various beam clamp assemblies. The adaptors of this invention are each configured to be mounted onto a particular type of beam clamp assembly, and each adaptor is provided with a connector for releasably attaching any of a plurality of clamping fixtures to the adaptors, whereby a particular clamping fixture can be interchangeably mounted on any of a plurality of different types of beam clamp assemblies, thus eliminating the need to match the clamping fixture for a particular job to a particular type of beam clamp assembly.

The adaptors in accordance with this invention include an adaptor block or body, a fastener attached to the adaptor block for releasably securing the adaptor block to a jaw of a beam clamp assembly, and a connector on the adaptor block for releasably attaching a workpiece clamping fixture to the adaptor block.

In accordance with one aspect of the invention, there is provided a clamping system for clamping workpieces for various operations. The system includes a beam clamp assembly, or a plurality of different types of beam clamp assemblies, each of which may have jaws which are differently configured; an adaptor having a fastener specially configured to facilitate releasable attachment to the jaws of the beam clamp assembly, or a plurality of adaptors, each having a fastener specially configured to facilitate releasable attachment to one of the plurality of different types of beam clamp assemblies having differently configured jaws, each of the adaptors including a connector for releasably attaching a workpiece clamping fixture to the adaptor; and one or more workpiece clamping fixtures, each clamping fixture including a connector configured to engage the connector on any of the adaptors and facilitate releasable attachment of the clamping fixture to any of the adaptors. The clamping system of this invention thus allows a workpiece clamping fixture to be mounted onto, and to be used with, any of a plurality of different beam clamp assemblies having differently configured jaws. By providing a clamping system which allows any of a plurality of different types of workpiece clamping fixtures to be used with any of a plurality of different types of beam clamp assemblies having differently configured jaws, greater flexibility in the selection of clamping fixtures and beam clamp assemblies for performing a particular job on a particular workpiece is provided. More specifically, workers are not limited by the requirement of having to utilize a particular workpiece clamping fixture with a particular type of bar clamp assembly having jaws which are configured to cooperatively receive integral fasteners on the workpiece clamping fixture.

In accordance with another aspect of the invention, the adaptor includes a workpiece-engaging surface which faces toward an opposing second jaw of the beam clamp assembly when the adaptor is secured to a first jaw of the beam clamp assembly. The workpiece-engaging surface allows the adaptor to be used as a clamp pad when a workpiece fixture is not mounted on the adaptor. This feature eliminates the need for replacing the workpiece fixture with a protective clamp pad when the beam clamp assembly is reconfigured from being used with a specialty workpiece fixture to being used to clamp a workpiece having opposing parallel, planar surfaces which are to be gripped between the jaws of the beam clamp assembly. Accordingly, the difficult tasks of mounting the workpiece fixtures onto the jaws and demounting the workpiece fixtures from the jaws during reconfiguration is eliminated. Such tasks being difficult and time consuming on account of the extremely low tolerances between the jaws and the integral fasteners on conventional clamping fixtures. Instead, in accordance with this aspect of the invention, the adaptors are firmly secured to the jaws and do not need to be removed during reconfiguration of the beam clamp assembly between a configuration in which a specialty clamping fixture is utilized and one in which flat, parallel surfaces of a workpiece are to be gripped between the jaws, because the adaptors are provided with integral opposing gripping surfaces which generally serve the protective function of conventional clamping pads. Further, instead of detaching the clamping fixture from the jaw, as is required with conventional clamping systems, the clamping fixtures of the present invention are detachable from the adaptors for reconfiguration of the beam clamp assembly. In accordance with a preferred aspect of this invention, detachment of a clamping fixture from an adaptor can be a relatively simple task, which can be facilitated with a threaded fastener, with a snap-type connector, or with any of various other connectors which facilitate quick connection of the fixture to the adaptor and quick detachment of the fixture from the adaptor.

In accordance with a further aspect of the invention, there is provided a clamping fixture including a clamping body defining workpiece-engaging surfaces, and an adaptor portion which is integrally connected to, or integrally formed with, the clamping body. The adaptor portion includes first and second fastener clips for releasably securing the clamping fixture to one of the jaws of a beam clamp assembly. The clips are adjustable to allow variation of gripping forces with which the adaptor portion engages the jaw, so that the clips can be loosened to allow the adaptor portion to be easily mounted onto and removed from the jaw, and tighten to allow firm securement of the adaptor portion on the jaw. However, it will usually be unnecessary to loosen the clips. Instead, the fixture can be removed and replaced by sliding it onto or off of the jaws of the clamp assembly. In accordance with a preferred aspect of the invention, the clips are fastened to the adaptor portion with threaded fasteners, so that the clips can be removed from the adaptor portion and replaced with different clips which may be configured to engage the jaws of a different type of beam clamp assembly. Alternatively, the clips can be removed and used with different adaptors configured to be mounted on a differently configured jaw of a beam clamp assembly.

In accordance with another preferred aspect of the invention, the integral gripping surfaces of the adaptors can be made of a material which is relatively inflexible and relatively non-deformable as compared with rubber, so that true clamping pressure is achieved between the jaws and the workpiece. Also, because the gripping surface is integral to the adaptor, and because the adaptor includes fasteners for firmly securing the adaptor to the jaws of a beam clamp assembly, the possibility of the gripping surface or adaptor slipping or shifting relative to the jaws during clamping or subsequent operations on a workpiece is eliminated.

BRIEF DESCRIPTION OF THE DRAWINGS

FIG. 7 is a perspective view of an alternative embodiment of the adaptors in accordance with this invention, the adaptors being configured for mounting on an alternative beam clamp assembly;

FIG. 8 is a perspective view of a band clamp which is configured for use with the adaptors of this invention;

DESCRIPTION OF THE PREFERRED EMBODIMENTS

Figure 1:
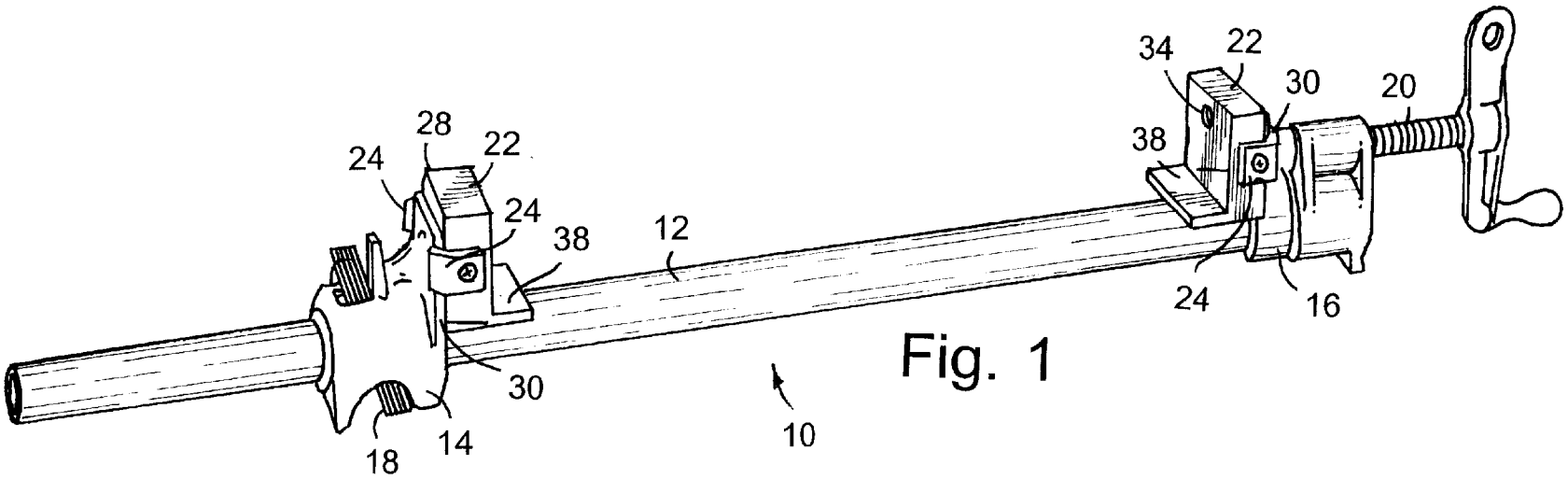
FIG. 1 is a perspective view of a beam clamp assembly having a pair of adaptors in accordance with the invention mounted on the jaws thereof.

In FIG. 1, there is shown a pipe clamp assembly 10 which comprises a linear pipe beam 12, and first and second jaws 14 and 16 respectively, which are slidably supported on linear pipe beam 12. Jaw 14 includes a locking mechanism, generally indicated at 18, for holding jaw 14 at a selected position on linear pipe beam 12. A linear actuator, generally indicated at 20, is provided on jaw 16 for linearly advancing jaw 16 toward and away from jaw 14 to apply and relieve pressure on an article or workpiece interposed between the jaws. An example of a pipe clamp assembly which is commercially available is the "Pony" #50 sold by Adjustable Clamp Co., Chicago, Ill.

A pair of adaptors 22 are releasably secured to each of the jaws 14 and 16. More specifically, the adaptors are provided with fastener clips 24 which are attached to an adaptor body or block 26, and which together with the rear wall 28 of adaptor block 26 engage and grip a vertical flange portion 30 of jaws 14 and 16, the vertical flange portion 30 defining opposing gripping surfaces for engaging a workpiece therebetween.

Figure 3:
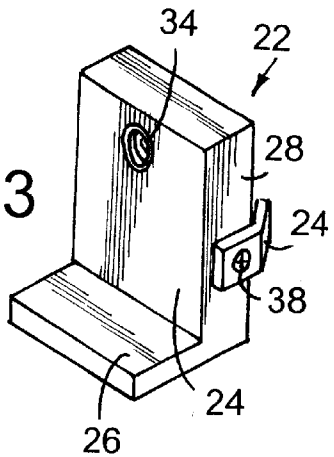
FIG. 3 is a front perspective view of an adaptor in accordance with this invention.
Figure 2:
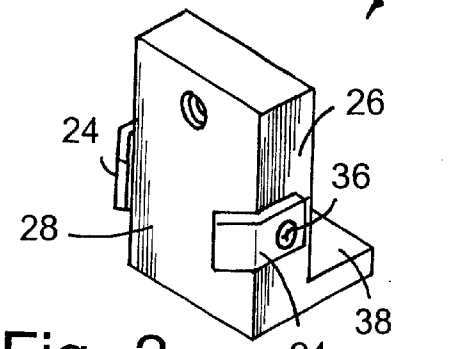
FIG. 2 is a rear perspective view of an adaptor in accordance with this invention.

With reference to FIGS. 2 and 3, which show rear and front perspective views of adaptor 22 in greater detail respectively, the front wall 32 of adaptor block 26 is provided with a connector 34 for releasably attaching a clamping fixture to the adaptor. Fastener clips 24 of the illustrated adaptors 22 are attached to adaptor block 26 by a threaded fastener 36. Threaded fasteners 36 allow the gripping forces between the adaptor 22 and the jaws 14, 16 of pipe clamp assembly 10 to be adjusted. This facilitates mounting of adaptors 22 to jaws 14 and 16, and demounting of adaptors 22 from jaws 14 and 16. Specifically, it is possible to loosen threaded fasteners 36 to allow adaptor 22 to be easily positioned on vertical flange portion 30 of jaws 14 and 16, and subsequently tighten to allow adaptors 22 to be firmly secured on jaws 14 and 16. Demounting is similarly facilitated. Additionally, by utilizing threaded fasteners 36 for attaching fasteners clips 24 to adaptor block 26, it is possible to completely remove fastener clips 24 from the adaptor block and replace them with different clips which are configured to engage a different type of beam clamp assembly having jaws with differently configured vertical flange portions or other attachment features. Although clips 24 are shown attached to adaptor block 26, by means of a threaded fastener, it is contemplated that clips 24 can be attached to adaptor blocks 26 using alternative fastening means, or clips 24 may be integrally formed with or integrally attached to adaptor blocks 26, without departing from the scope of this invention.

Front wall 32 of adaptor block 26 serves as a workpiece-engaging surface which faces toward an opposing workpiece-engaging surface of a second jaw on a beam clamp assembly when the adaptor is secured to a first jaw on the beam clamp assembly. Accordingly, it is not necessary to remove the adaptors 22 from jaws 14, 16 when reconfiguring the pipe clamp assembly 10 from a configuration in which a specialty clamping fixture is utilized and one in which flat, parallel surfaces of a workpiece are to be gripped between the jaws, because the workpiece-engaging surfaces provided by front walls 32 of adaptor blocks 26 provide opposing gripping surfaces which are integral to the adaptors. In fact, when reconfiguring the pipe clamp assembly 10 for clamping flat, parallel surfaces of a workpiece, it is generally desirable to utilize the workpiece-engaging surfaces provided by front wall 32 of adaptor blocks 26, to provide a protective layer which shields the workpiece from bumps and other protuberances which are generally present on the opposing faces of the vertical flange portions 30 of conventional jaws 14, 16. Further, the integral workpiece gripping surfaces 32 of adaptors 22 can be made of a material which is relatively inflexible and relatively non-deformable as compared with rubber, so that true clamping pressure is achieved between the jaws and the workpiece. Suitable materials for forming the workpiece gripping surfaces 32 include various woods, plastics and metals, specific materials include various hardwoods such as oak, maple, etc. Because the gripping surfaces 32 are integral to the adaptor, and because the adaptor includes fasteners for firmly securing the adaptor to the jaws of a pipe clamp assembly, the possibility of the gripping surfaces of the adaptors slipping or shifting relative to the jaws during clamping or subsequent operations on the workpiece is eliminated. The workpiece-engaging surfaces 32 of the illustrated adaptors 22 are substantially perpendicular to the longitudinal direction of the linear pipe beam 12 when the adaptors are secured to the jaws 14, 16 of the pipe clamp assembly. However, it is contemplated that the adaptors 22 can be provided with workpiece-engaging surfaces of different configurations. Of course, the workpiece-engaging surfaces 32 of the illustrated adaptor 22 can be provided with any of various types of coverings or cushioned pads which can be attached to wall 32 with adhesives or the like. Examples of surface coverings or pads which can be attached to the wall 32 include wood veneer, rubber, cork, felt or other types of materials which enhance gripping of the workpiece and/or cushion the workpiece. An advantage with the adaptor blocks 22 is that they can be easily configured to provide a workpiece-engaging surface 32 which is larger than the workpiece-engaging surface provided by the vertical flange portions 30 of conventional jaws 14, 16 of typical beam clamp assemblies.

Figure 4:
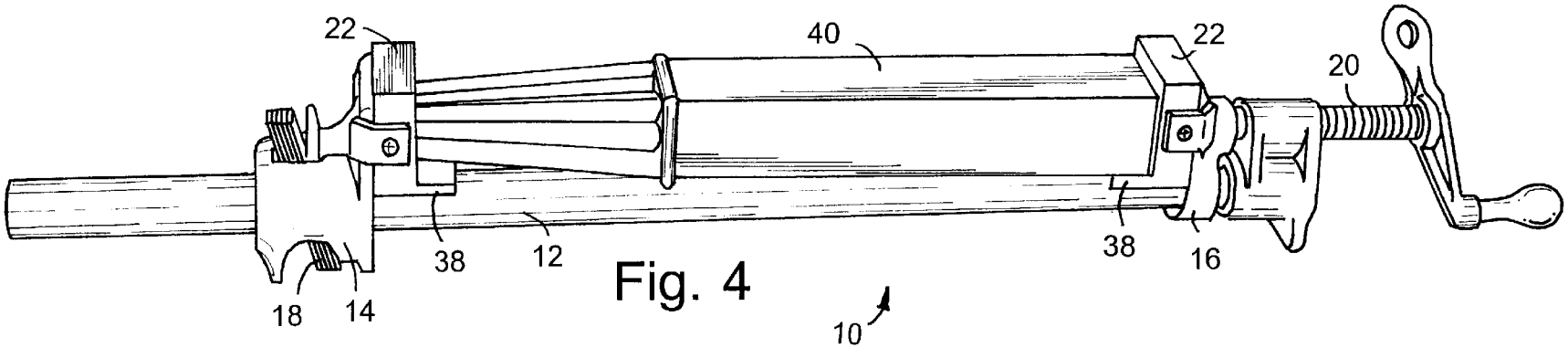
FIG. 4 is a perspective view of a workpiece being clamped by a beam clamp having adaptors, in accordance with the invention, mounted on the jaws thereof.

The connector 34 of the adaptor 22, illustrated in FIGS. 1 and 3, is an internally threaded bore which is configured to receive a threaded fastener. This allows clamping fixtures to be mounted onto, or demounted from, adaptors 22 more easily than conventional clamping fixtures, having integral fasteners such as sockets or clips, can be mounted onto, or demounted from, the jaws of a beam clamp assembly. Other types of connectors, such as snap-type connectors or other connectors which facilitate quick connection of the fixture to the adaptor and quick detachment of the fixture from the adaptor, can be used in place of the illustrated connector 34. Projecting horizontally from a lower edge of front wall 32 of adaptor block 26 is a protective ledge 38. When mounted on jaws 14, 16 of pipe clamp assemble 10, protective ledge 38 is disposed generally adjacent to linear pipe beam 12 such that it is interposed between a workpiece and the linear pipe beam when a workpiece is engaged by the workpiece-engaging surfaces 32 of the adaptors 22, so that contact between a workpiece 40 and the linear pipe beam is avoided, as illustrated in FIG. 4.

Figure 5:
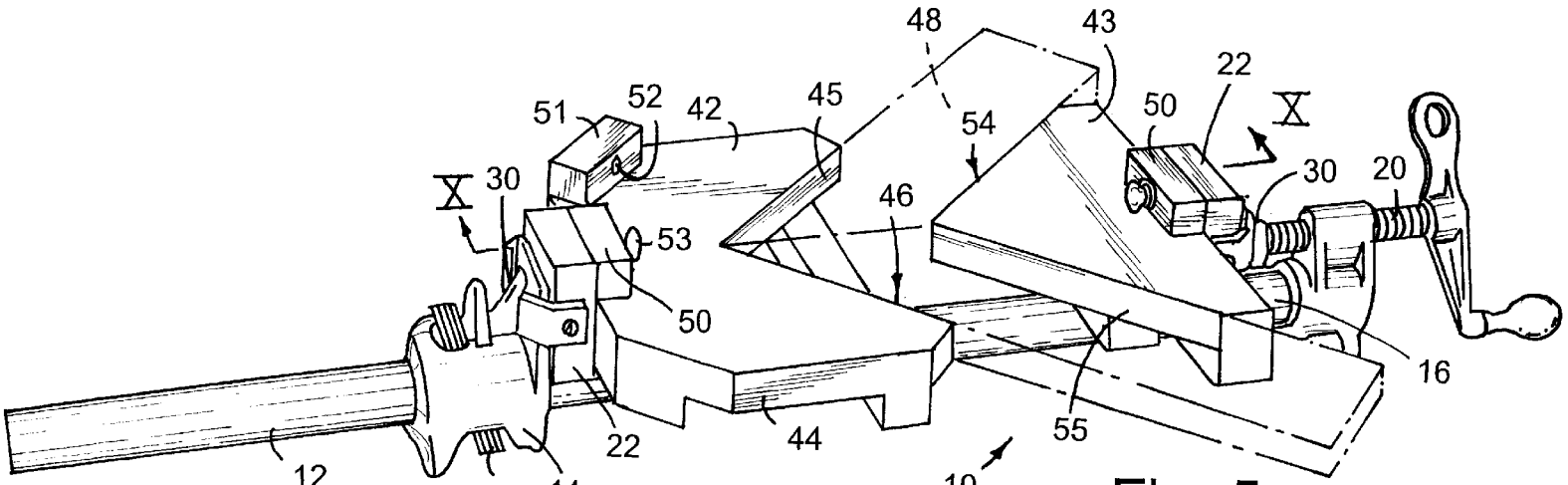
FIG. 5 is a perspective view of a beam clamp having adaptors, in accordance with this invention, mounted on the jaws thereof, and having miter fixtures mounted on the adaptors.
Figure 10:
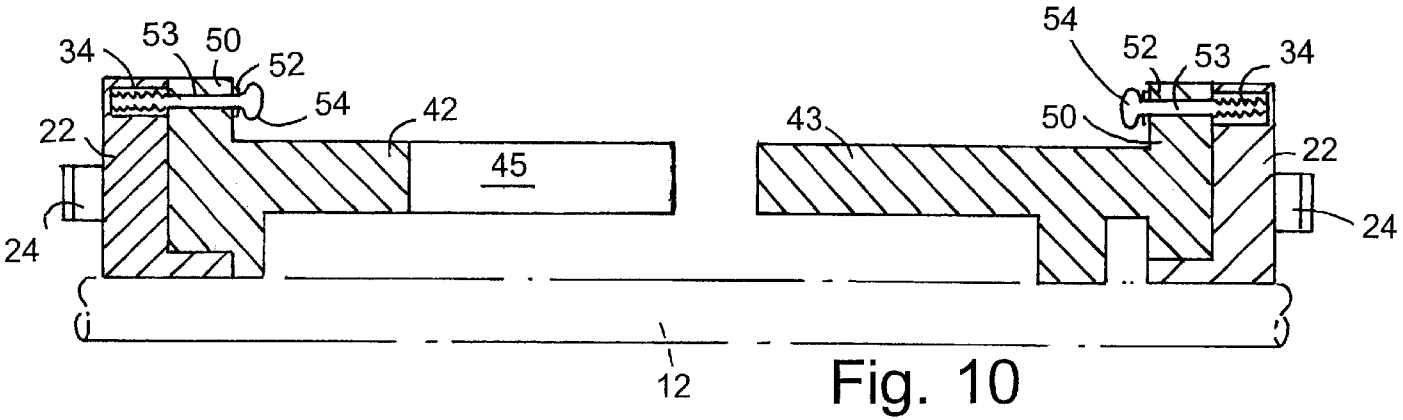
FIG. 10 is a vertical cross-sectional view of the beam clamp assembly shown in FIG. 5, as viewed along lines X—X.

In FIG. 5, there is illustrated a pipe clamp assembly 10, as previously described, having adaptors 22 mounted on vertical flange portions 30 of jaws 14, 16, and having miter fixtures 42 and 43 mounted on respective adaptors 22. Fixture 42 includes a fixture body 44 defining vertical workpiece-engaging surfaces 45 and 46, which are angularly displaced with respect to each other by 90 degrees. Workpiece-engaging surfaces 45 and 46 are configured to engage the exterior 90 degree corner of a workpiece 48 (shown in phantom). The term "workpiece" as used herein can mean either a single integral workpiece, or a plurality of parts which are being held together for gluing or other operations. Miter fixture 42 also includes first and second mounting blocks 50 and 51 which allow fixture 42 to be mounted in either of two alternative orientation, shown in FIGS. 5 and 6 respectively. Each of the mounting blocks includes a connector comprising a bore 52 and a threaded fastener 53. As shown in FIG. 10, threaded fastener 53 passes through bore 52 of mounting block 50 or 51 and threadingly engages and passes into threaded bore 34 of adaptor 22 to attach fixture 42 to adaptor 22. To eliminate the need for tools, such as screwdrivers, threaded fastener 53 can be provided with a thumb screw which allows the threaded fastener to be tightened and loosened by hand. Miter fixture 43 includes workpiece-engaging surfaces 54 and 55 which are angularly displaced from each other by 270 degrees to allow engagement of the surfaces 55 and 56 with the internal right angle of a workpiece 48. Miter fixture 43 includes a mounting block 50 having a bore in which threaded fastener 53 is received. Miter fixture 43 is attached to an adaptor 22 in a manner analogous to the manner in which miter fixture 42 to attached to an adaptor 22, as illustrated in FIG. 10.

Figure 6:
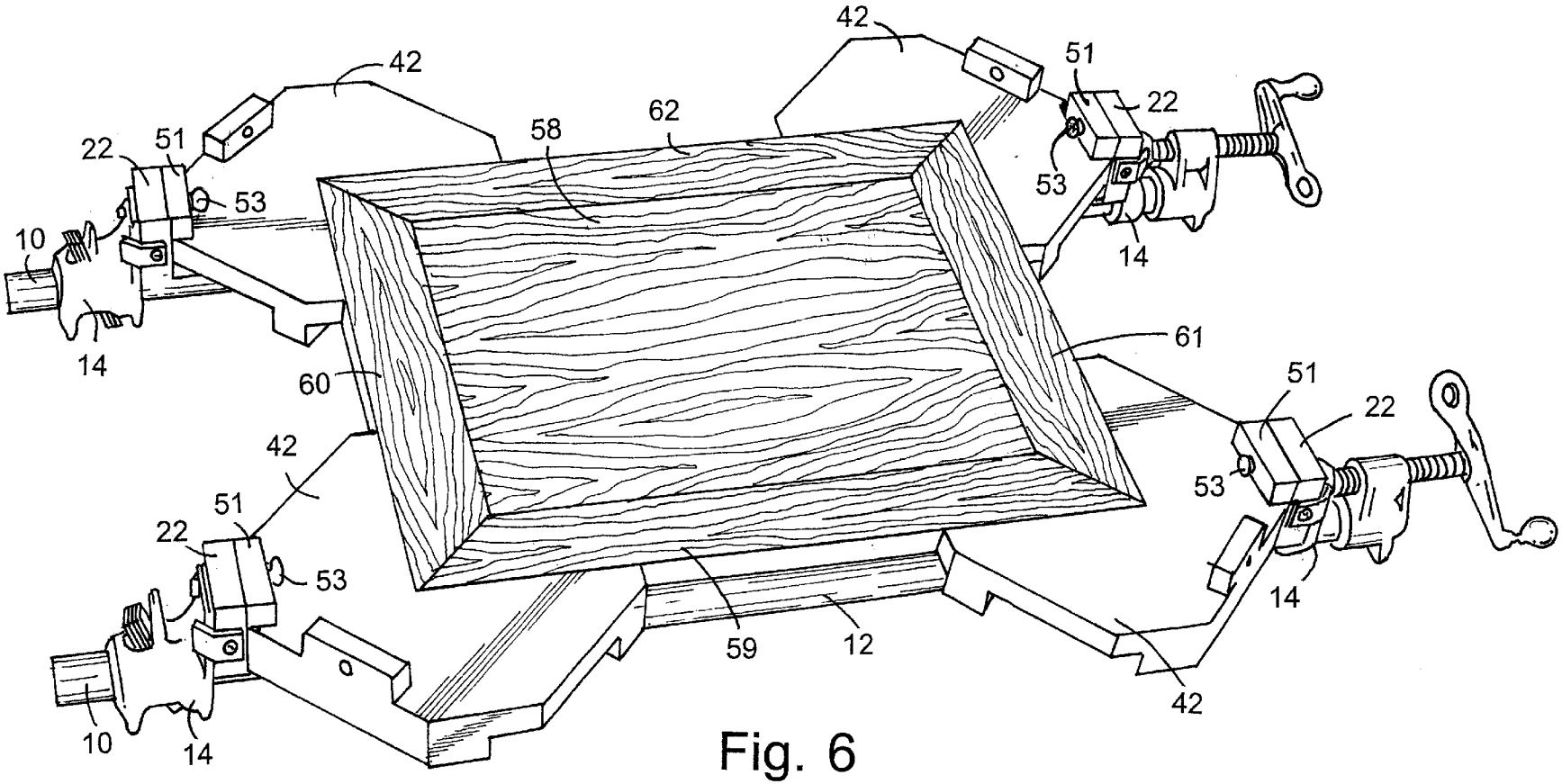
FIG. 6 is a perspective view of a pair of beam clamps being used in association with adaptors in accordance with this invention, and with a plurality of miter fixtures, to clamp a rectangular workpiece by gripping and applying pressure to the corners thereof.

FIG. 6 shows two pipe clamp assemblies 10, each including a linear pipe beam 12, and a pair of opposing jaws 14 and 16, being used in combination with four adaptors 22, one of which is attached to each of the respective jaws, and four miter fixtures 42, to clamp together edge rails 58, 59, 60 and 61 and core piece 62, such as to allow glue disposed between the joining surfaces of the rails and the core piece to dry.

FIG. 7 shows a bar clamp assembly 70 having jaws 72 and 73. Jaw 72 is fixed at one end of beam 74, and jaw 73 includes a combination locking device (not shown) and linear actuator for linearly advancing jaw 73 toward and away from jaw 72 to apply and relieve pressure on an article interposed between the jaws. The locking device and linear actuator are engaged by manipulation of handle 75. An example of a commercially available bar clamp assembly is the "Bessey K-BODY CLAMP" sold by American Clamping Company, Batavia, N.Y. Also shown in FIG. 7 are a pair of alternative adaptors 76 having fastener clips 77 connected thereto. Adaptors 76 and fastener clips 77 are configured to be positioned over, and together firmly engage, jaws 72 and 73. Similar to adaptors 22, adaptors 76 include workpiece-engaging surfaces 78 (analogous to workpiece-engaging surface 32 of adaptor 22) and connectors 79 (which are analogous to connectors 34 of adaptor 22). More specifically, the illustrated connector 79 is a threaded bore which is adapted to receive a threaded fastener.

FIG. 8 shows a band clamp 80 having bores 81 and 82 through mating clamp blocks 83 and 84 respectively. Threaded fasteners 53 can be passed through bores 81 and 82 respectively and into engagement with threaded bores 79 of adaptor 76, as shown. Alternatively, band clamp 80 can be attached to adaptors 22 (shown in FIGS. 1–3) by passing threaded fasteners 53 through bores 81 and 82 and into engagement with threaded bores 34 of adaptors 22. Band clamp 80 includes a metal band 85 connected to each of the blocks 83 and 84. The connection to block 83 can be a fixed connection, and the connection to block 84 can be an adjustable connection in which band 85 can be drawn in either direction through an elongate aperture 86 and held in place by set screw 87 which extends through threaded bore 88 to the passageway defined by slot 86 to allow the end of set screw 87 to engage band 85. In order to insure proper connection between clamp block 83 and 84, clamp block 84 can be provided with a pair of dowels 89 which engage holes (not shown) provided in mating clamp block 83. A similar arrangement is shown and described with reference to a strap clamp shown in FIG. 9. Band clamp 80 is ideally suited for clamping circular, elliptical or other continuously curved workpieces. For example, band clamp 80 can be used for holding perimeter rails 90, 91 and 92 in engagement with circular core 93, such as to allow glue disposed between adjacent abutting surfaces of the rails and core to dry.

Figures 9, 9A:
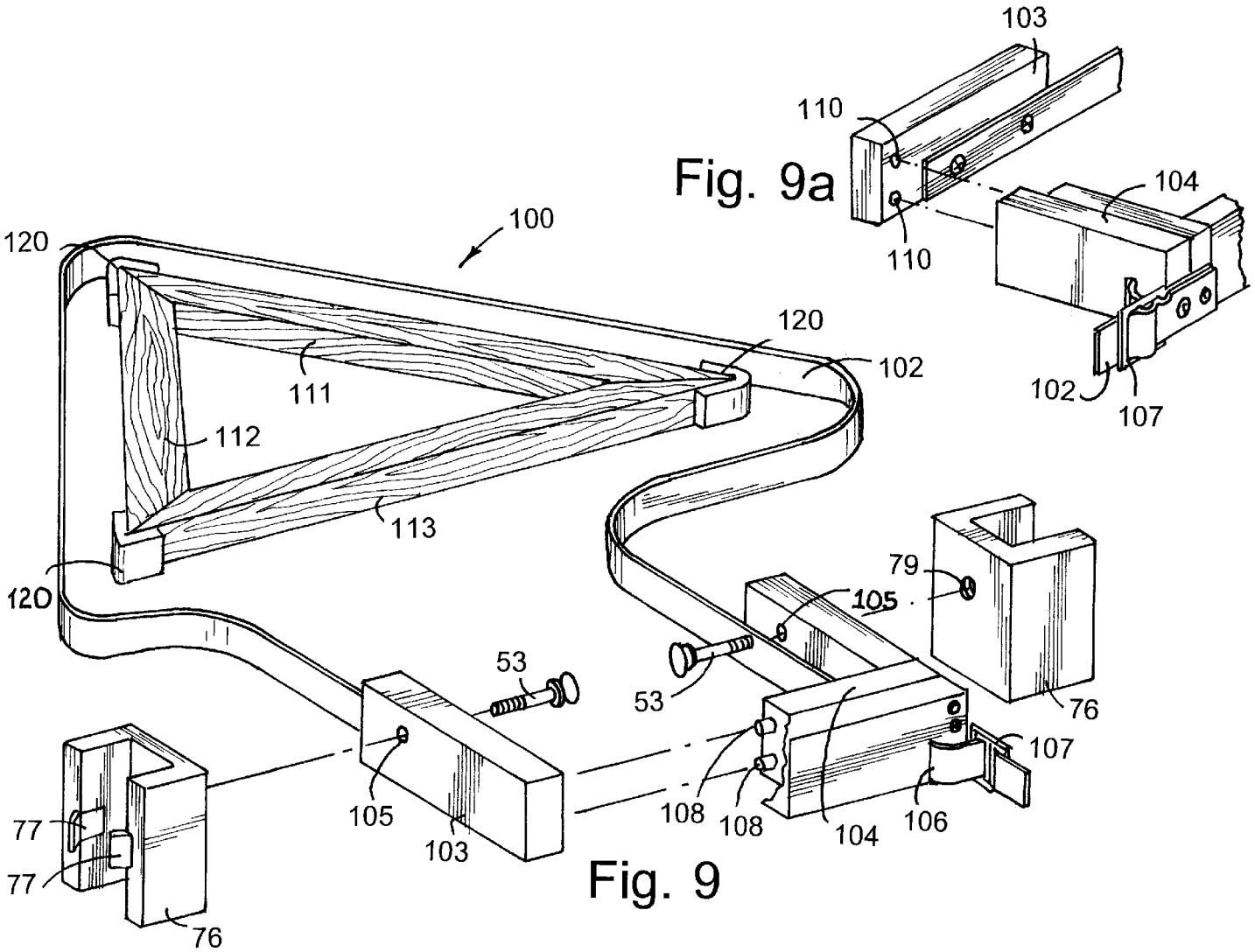
FIG. 9 is a front perspective view of a strap clamp configured for use with the adaptors of this invention.
FIG. 9A is a fragmentary rear perspective view of the strap clamp shown in FIG. 9.

In FIGS. 9 and 9A, there is shown a strap clamp fixture 100 including a cloth strap 102, such as a woven nylon strap, which is attached near opposite ends thereof to mating clamp blocks 103 and 104. Blocks 103 and 104 can be attached to adaptor 76 by passing threaded fasteners 53 through bores 105 and into engagement with threaded bores 79 of adaptors 76. Strap 102 can be fixedly connected to block 103 and adjustably connected to block 104. For example, an elongate aperture 106 can extend through a portion of block 104 to allow strap 102 to be drawn therethrough in either direction and held by a buckle 107. As with band clamp 80, strap clamp 100 is provided with mating blocks 103 and 104 having dowels 108 which project from block 104 and matably engage circular apertures 110 in block 103. Strap clamp 100 can be used for holding together or clamping a workpiece having a circular or polygonal shape. For example, strap clamp fixture 100 can be used for holding together rails 111, 112 and 113 of a triangular workpiece, such as to allow glue disposed between the adjoining surfaces of the rails to dry. Corner pieces 120 can be used in association with clamp fixture 100 to concentrate clamping forces along the joining surfaces near the vertices of the workpiece.

Figure 11:
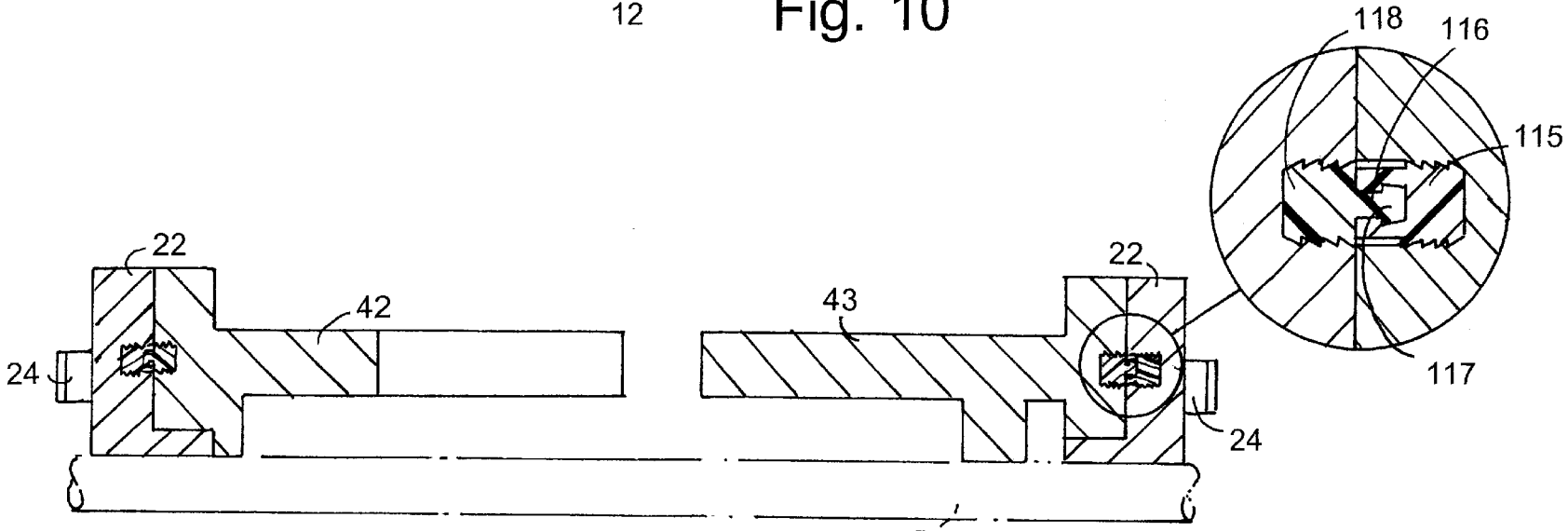
FIG. 11 is an alternative cross-sectional view of the beam clamp assembly shown in FIG. 5, as viewed along lines X—X.

While the invention has been generally described with reference to clamping systems wherein clamping fixtures are attached to adaptors by means of a threaded fastener which passes through a bore through the fixtures and into threaded engagement with threaded bores extending through the adaptors, various alternative types of connections, especially those which allow quick connection of the fixture to the adaptor and quick disconnection of the fixture from the adaptor, can be utilized. As a specific example, in FIG. 11, there is illustrated a snap-type connector system comprising a socket connector 115 having a socket 116 which is adapted to receive a plug 117 projecting from a plug connector 118. When a snap-type connector is used, it is preferred that the socket connector 115 be provided on the adaptor, and that the plug type connector 118 be provided on the clamping fixture, so that the workpiece-engaging surface 32 of adaptor 22 does not have any projections which would interfere with the clamping of a workpiece against workpiece-engaging surface 32.

Figure 12:
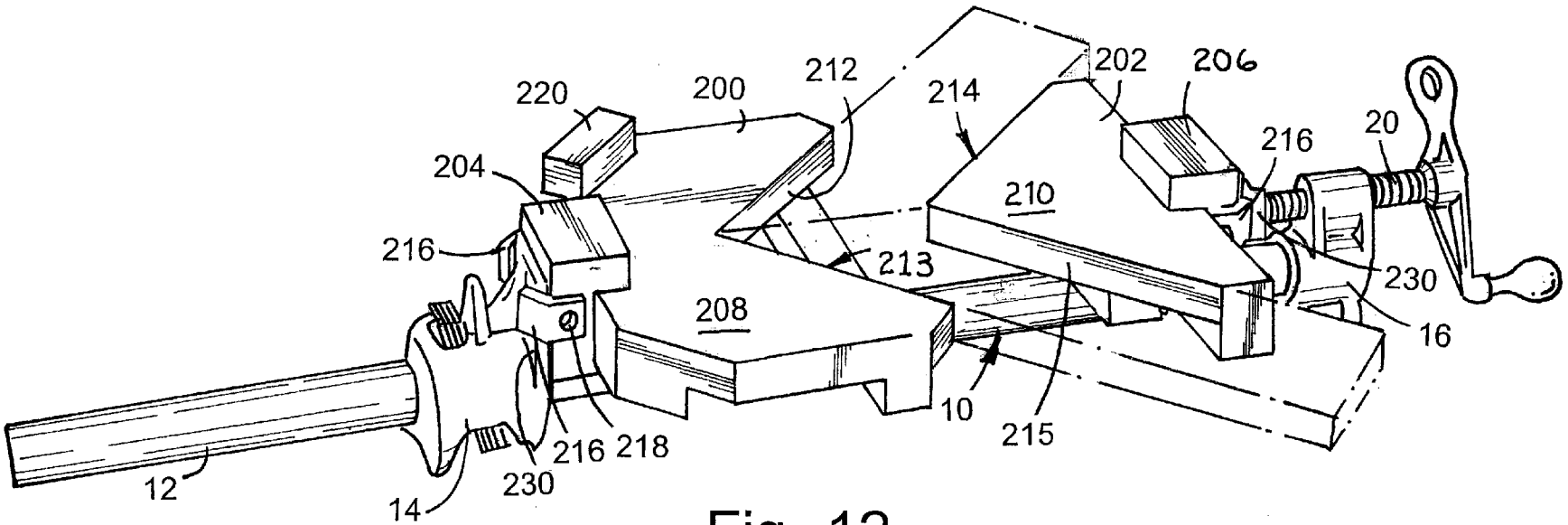
FIG. 12 is a perspective view of an alternative embodiment of the invention wherein the clamping fixture includes an integral adaptor portion.

In FIG. 12 there is shown an alternative embodiment of the invention of the clamping fixtures of this invention, wherein the adaptor is an integral portion of the fixture. Clamping fixtures 200 and 202 are generally similar to clamping fixtures 42 and 43 shown in FIG. 5, the difference being that FIG. 5 shows clamping fixtures which are releasably connected to adaptors 22, whereas the fixtures 200 and 202 shown in FIG. 12 have adaptor portions 204 and 206 which are integrally attached to or integrally formed with clamping bodies 208 and 210 respectively. Thus, clamping bodies 208 and 210 are not releasably connected with adaptor portions 204 and 206, but instead are permanently attached thereto. The expression "permanently attached" means that the adaptor portions 204 and 206 and clamping bodies 208 and 210 are not provided with any means for releasably connecting the adaptors to the clamping bodies, such that separation of the adaptor portions from the clamping bodies would result in damaging or at least physically altering or modifying the structure of the clamping fixture. Clamping body 208 defines workpiece-engaging surfaces 212 and 213, and clamping body 210 defines workpiece-engaging surfaces 214 and 215. The adaptor portions 204 and 206 each include first and second fastener clips 216 for releasably securing the clamping fixtures 200 and 202 to jaws 14 and 16 respectively of the beam clamp assembly 10. The clips 216 are adjustable to allow variation of gripping forces with which the adaptor portion engages the jaw. Specifically, with the illustrated embodiment, clips 216 are attached to the adaptor blocks 204 and 206 with threaded fasteners 218, which allow the clips to be loosened so that the adaptor can be easily mounted onto and removed from the jaws, and tightened to allow firm securement of the adaptor portions on the jaws. Specifically, with the illustrated embodiment, clips 216 are attached to the adaptor blocks 204 and 206 with threaded fasteners 218, which allow the clips to be loosened so that the adaptor can be easily mounted onto and removed from the jaws, and tightened to allow firm securement of the adaptor portions on the jaws. The threaded fasteners 218 allow the clips 216 to be completely removed from the adaptor portions 204 and 206, so that the clips 226 can be removed and replaced with different clips which may be configured to engage different jaws of a different beam clamp assembly. Fixture 200 is provided with an alternative adaptor portion 220, which is substantially similar to adaptor portion 204, to allow the clamping fixture to be releasably attached to the jaw of a beam clamp assembly in any of a plurality of alternative orientations. Fixtures 200 and 202 having integral adaptor portions 204 and 206 may be particularly appealing to those who prefer to use conventional rubber pads when reconfiguring a beam clamp assembly from use with specialty clamping fixtures such as 200 and 202, to a configuration in which the oppositely facing surfaces of jaws 14 and 16 are used to grip a workpiece having opposing, flat, parallel surfaces. Specifically, the combination clamping fixture with integral adaptor allows easy reconfiguration of the assembly by removing the fixtures 200 and 202 from the jaws, such as by loosening screws 218 and lifting clamping fixtures 200 and 202 upwardly, and slipping a conventional rubber clamping pad over the vertical flange portions 230 of jaws 14 and 16 of the clamp assembly. Also, with respect to the Bessey K-BODY style clamp assembly, which has a non-removable protective plastic surface covering its jaws, the one-piece clamping fixture with integral adaptor may be desirable to some, as protection is automatic at the removal of the fixture/adaptor. In the case of certain other commercially available beam clamp assemblies, such as the Gross-Stabil parallel clamp, the clamp is provided with removable, protective (plastic) clamp pads, such that a one-piece fixture/adaptor specially configured for the clamp assembly, can be removed from the jaws of the clamp, and the supplied protective pads can be reattached, as desired.

It will be apparent to those skilled in the art that various modifications to the preferred embodiments of the invention as described herein can be made without departing from the spirit or scope of the invention as defined by the appended claims.

The embodiments of the invention in which an exclusive property or privilege is claimed are defined as follows:

1. An adaptor for interchangeably connecting any of a plurality of clamping fixtures to a beam clamp assembly, comprising:

an adaptor block;

first and second fastening clips configured to engage rear edges of a jaw of a beam clamp assembly;

a connector on the adaptor block for releasably attaching a workpiece clamping fixture to the adaptor block;

the adaptor block including a flat, forwardly-facing workpiece-engaging surface and a rearwardly-facing jaw-engaging surface;

the first and second fastening clips projecting rearwardly and toward each other from opposite sides of the adaptor block, whereby the adaptor is releasably attachable to a jaw of a beam clamp assembly; and a protective ledge which extends integrally from the workpiece-engaging surface so that it is disposed adjacent to a beam of a beam clamp assembly when the adaptor is mounted on the beam clamp assembly, whereby the ledge is interposed between a workpiece and the beam when a workpiece is engaged by the workpiece-engaging surface of the adaptor mounted a jaw of the beam clamp assembly, and whereby contact between the workpiece and the beam is avoided.

2. An adaptor for interchangeably connecting any of a plurality of clamping fixtures to a beam clamp assembly, comprising:

an adaptor including an adaptor block and first and second clips configured to engage rear edges of a jaw of a beam clamp assembly, the adaptor block having a flat, forwardly-facing workpiece-engaging surface and a rearwardly-facing jaw-engaging surface, the first and second clips projecting rearwardly and toward each other from opposite sides of the adaptor block, whereby the adaptor is releasably attachable to a jaw of a beam clamp assembly; and a connector on the adaptor for translationally fixing and releasably attaching a workpiece clamping fixture to the adaptor.

3. The adaptor of claim 2, wherein the fastening clips are adjustable to allow variation of gripping forces with which the adaptor engages the jaw, whereby the clips can be loosened to allow the adaptor to be easily mounted onto and removed from the jaw, and tightened to allow firm securement of the adaptor on the jaw.

4. The adaptor of claim 2, wherein the clips are fastened to the adaptor with threaded fasteners, whereby the clips can be removed from the adaptor block and replaced with different clips configured to engage a different type of beam clamp assembly.

5. The adaptor of claim 2, wherein the connector on the adaptor block is an internally threaded bore configured to receive a threaded fastener.

6. An adaptor for interchangeably connecting any of a plurality of clamping fixtures to a beam clamp assembly, comprising:

an adaptor including an adaptor block and first and second clips configured to engage rear edges of a jaw of a beam clamp assembly, the adaptor block having a flat forwardly-facing workpiece-engaging surface and a rearwardly-facing jaw-engaging surface, the first and second fastening clips projecting rearwardly and toward each other from opposite sides of the adaptor block, whereby the adaptor is releasably attachable to a jaw of a beam clamp assembly; and a connector on the adaptor for translationally fixing and releasably attaching a workpiece clamping fixture to the adaptor, the forwardly-facing workpiece-engaging surface being free of projections, and the connector being recessed in the forwardly-facing workpiece-engaging surface, whereby the forwardly-facing workpiece-engaging surface is flat and uninterrupted except for the recessed connector.

7. The adaptor of claim 6, wherein the adaptor includes a workpiece-engaging surface which faces toward an opposing second jaw of a beam clamp assembly when the adaptor is secured to a first jaw of the beam clamp assembly.

8. The adaptor of claim 7, wherein the workpiece-engaging surface is substantially perpendicular to the longitudinal direction of the beam of the beam clamp assembly when the adaptor is secured to a jaw of the beam clamp assembly.

9. The adaptor of claim 7, wherein the workpiece-engaging surface is less flexible than rubber.

10. The adaptor of claim 7, wherein the adaptor includes a protective ledge which extends from the workpiece-engaging surface and is disposed adjacent to a beam clamp assembly when the adaptor is mounted on the beam clamp assembly, whereby the ledge is interposed between a workpiece and the beam when a workpiece is engaged by the workpiece-engaging surface of the adaptor mounted on a jaw of the beam clamp assembly, so that contact between the workpiece and the beam is avoided.

11. A combination beam clamp assembly and an adaptor for interchangeably connecting any of a plurality of clamping fixtures to a beam clamp assembly, comprising:

a beam clamp including a beam and a pair of opposing jaws;

an adaptor releasably attached to a jaw of the beam clamp assembly, the adaptor including an adaptor block and first and second fastening clips configured to engage rear edges of the jaw of the beam clamp assembly, the adaptor block having a flat forwardly-facing workpiece-engaging surface and a rearwardly-facing jaw-engaging surface, the first and second clips projecting rearwardly and toward each other from opposite sides of the adaptor block, whereby the adaptor is releaseably attached to the jaw of the beam clamp assembly; and a connector on the adaptor for translationally fixing and releasably attaching a workpiece clamping fixture to the adaptor, the forwardly-facing workpiece-engaging surface being free of projections, and free of recesses other than the connector, whereby the forwardly-facing workpiece-engaging surface is flat and substantially uninterrupted except for the recessed connector.

* * * * *

UNITED STATES PATENT AND TRADEMARK OFFICE

CERTIFICATE OF CORRECTION

PATENT NO. : 6,338,478 B2
DATED : January 15, 2002
INVENTOR(S) : Eric J. Baculy

It is certified that error appears in the above-identified patent and that said Letters Patent is hereby corrected as shown below:

Column 5,
Line 25, “fasteners clips” should be -- fastener clips --.

Column 6,
Line 27, before “can be” insert -- that --.
Line 35, “assemble” should be -- assembly --.
Line 56, “orientation” should be -- orientations --.

Column 7,
Line 6, “to” should be -- is --.

Column 8,
Line 21, “connections” should be -- connectors --.

Column 10,
Line 2, after “mounted” insert -- on --.
Line 67, after “adjacent to a” insert -- beam of a --.

Signed and Sealed this

Twelfth Day of November, 2002

*Attest:*

*Attesting Officer*

JAMES E. ROGAN
*Director of the United States Patent and Trademark Office*